US008297364B2

(12) United States Patent
Agrawal et al.

(10) Patent No.: US 8,297,364 B2
(45) Date of Patent: Oct. 30, 2012

(54) TELESCOPIC UNIT WITH DISSOLVABLE BARRIER

(75) Inventors: Gaurav Agrawal, Aurora, CO (US); Zhiyue Xu, Cypress, TX (US); Bennett Richard, Kingwood, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 12/633,683

(22) Filed: Dec. 8, 2009

(65) Prior Publication Data

US 2011/0132612 A1 Jun. 9, 2011

(51) Int. Cl.
*E21B 29/02* (2006.01)

(52) U.S. Cl. ..... 166/376; 166/317; 166/373; 166/386

(58) Field of Classification Search ..... 166/317, 166/319, 332.4, 373, 376, 386
See application file for complete search history.

(56) References Cited

U.S. PATENT DOCUMENTS

| | | | | |
|---|---|---|---|---|
| 2,261,292 | A | 11/1941 | Salnikov | |
| 3,106,959 | A | 10/1963 | Huitt et al. | |
| 3,326,291 | A | 6/1967 | Zandmer et al. | |
| 3,390,724 | A * | 7/1968 | Caldwell | 166/100 |
| 3,637,446 | A | 1/1972 | Elliott et al. | |
| 3,645,331 | A | 2/1972 | Maurer et al. | |
| 3,775,823 | A | 12/1973 | Adolph et al. | |
| 3,894,850 | A | 7/1975 | Kovalchuk et al. | |
| 4,010,583 | A | 3/1977 | Highberg | |
| 4,157,732 | A | 6/1979 | Fonner | |
| 4,499,048 | A | 2/1985 | Hanejko | |
| 4,499,049 | A | 2/1985 | Hanejko | |
| 4,539,175 | A | 9/1985 | Lichti et al. | |
| 4,664,962 | A | 5/1987 | DesMarais, Jr. | |
| 4,673,549 | A | 6/1987 | Ecer | |
| 4,693,863 | A | 9/1987 | Del Corso et al. | |
| 4,716,964 | A | 1/1988 | Erbstoesser et al. | |
| 4,741,973 | A | 5/1988 | Condit et al. | |
| 4,853,056 | A | 8/1989 | Hoffman | |
| 4,929,415 | A | 5/1990 | Okazaki | |
| 4,952,902 | A | 8/1990 | Kawaguchi et al. | |
| 4,975,412 | A | 12/1990 | Okazaki et al. | |
| 5,084,088 | A | 1/1992 | Okazaki | |

(Continued)

FOREIGN PATENT DOCUMENTS

EP 1798301 A1 8/2006

(Continued)

OTHER PUBLICATIONS

International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.

(Continued)

*Primary Examiner* — Giovanna Wright
*Assistant Examiner* — Richard Alker
(74) *Attorney, Agent, or Firm* — Cantor Colburn LLP

(57) ABSTRACT

A telescopic member includes, at least a central component and a barrier disposed within the central component, the barrier has a selectively tailorable dissolution rate curve and has structural properties enabling the containment of high pressure prior to structural failure of the barrier through dissolution.

20 Claims, 5 Drawing Sheets

U.S. PATENT DOCUMENTS 5,252,365 A 10/1993 White
5,292,478 A 3/1994 Scorey
5,309,874 A 5/1994 Willermet et al.
5,380,473 A 1/1995 Bogue et al.
5,425,424 A 6/1995 Reinhardt et al.
5,456,327 A 10/1995 Denton et al.
5,479,986 A 1/1996 Gano et al.
5,529,746 A 6/1996 Knoss et al.
5,536,485 A 7/1996 Kume et al.
5,772,735 A 6/1998 Sehgal et al.
5,829,520 A 11/1998 Johnson
5,941,309 A 8/1999 Appleton
5,985,466 A 11/1999 Atarashi et al.
6,069,313 A 5/2000 Kay
6,189,618 B1 2/2001 Beeman et al.
6,238,280 B1 5/2001 Ritt et al.
6,261,432 B1 7/2001 Huber et al.
6,287,445 B1 9/2001 Lashmore et al.
6,341,747 B1 1/2002 Schmidt et al.
6,403,210 B1 6/2002 Stuivinga et al.
6,491,097 B1 12/2002 ONeal et al.
6,612,826 B1 9/2003 Bauer et al.
6,613,383 B1 9/2003 George et al.
6,713,177 B2 3/2004 George et al.
6,887,297 B2 5/2005 Winter et al.
6,913,827 B2 7/2005 George et al.
6,939,388 B2 9/2005 Angeliu
7,013,998 B2 3/2006 Ray et al.
7,017,677 B2 3/2006 Keshavan et al.
7,168,494 B2 1/2007 Starr et al.
7,250,188 B2 7/2007 Dodelet et al.
7,322,417 B2 1/2008 Rytlewski et al.
7,350,582 B2 4/2008 McKeachnie et al.
7,353,879 B2 4/2008 Todd et al.
7,363,970 B2 4/2008 Corre et al.
7,401,648 B2 7/2008 Richard
7,416,029 B2 8/2008 Telfer et al.
7,441,596 B2 10/2008 Wood et al.
7,509,993 B1 3/2009 Turng et al.
7,559,357 B2 7/2009 Clem
7,579,087 B2 8/2009 Maloney et al.
7,604,049 B2 10/2009 Vaidya et al.
2002/0104616 A1 8/2002 De et al.
2002/0136904 A1 9/2002 Glass et al.
2003/0111728 A1 6/2003 Thai et al.
2003/0150614 A1 8/2003 Brown et al.
2004/0005483 A1 1/2004 Lin
2004/0231845 A1 11/2004 Cooke
2005/0102255 A1 5/2005 Bultman
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0205264 A1 9/2005 Starr et al.
2005/0205265 A1 9/2005 Todd et al.
2006/0012087 A1 1/2006 Matsuda et al.
2006/0045787 A1 3/2006 Jandeska et al.
2006/0057479 A1 3/2006 Niimi et al.
2006/0110615 A1 5/2006 Karim et al.
2006/0116696 A1 6/2006 Odermatt et al.
2006/0131031 A1 6/2006 McKeachnie et al.
2006/0144515 A1 7/2006 Tada et al.
2007/0044958 A1 3/2007 Rytlewski et al.
2007/0057415 A1 3/2007 Katagiri et al.
2007/0062644 A1 3/2007 Nakamura et al.
2007/0074873 A1 4/2007 McKeachnie et al.
2007/0107908 A1 5/2007 Vaidya et al.
2007/0131912 A1 6/2007 Simone et al.
2007/0151009 A1 7/2007 Conrad, III et al.
2007/0169935 A1 7/2007 Akbar et al.
2007/0181224 A1 8/2007 Marya et al.
2007/0221373 A1 9/2007 Murray
2007/0259994 A1 11/2007 Tour et al.
2007/0261862 A1 11/2007 Murray
2008/0020923 A1 1/2008 Debe et al.
2008/0047707 A1 2/2008 Boney et al.
2008/0081866 A1 4/2008 Gong et al.
2008/0105438 A1* 5/2008 Jordan et al. ..... 166/376
2008/0121436 A1 5/2008 Slay et al.
2008/0127475 A1 6/2008 Griffo
2008/0149351 A1 6/2008 Marya et al.
2008/0248205 A1 10/2008 Blanchet et al.
2008/0296024 A1 12/2008 Huang et al.
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0084600 A1 4/2009 Severance
2009/0152009 A1 6/2009 Slay et al.
2009/0159289 A1 6/2009 Avant et al.
2009/0226340 A1 9/2009 Marya
2009/0255667 A1 10/2009 Clem et al.
2010/0015002 A1 1/2010 Barrera et al.
2010/0294510 A1 11/2010 Holmes
2011/0132143 A1 6/2011 Xu et al.
2011/0132612 A1 6/2011 Agrawal et al.
2011/0132619 A1 6/2011 Agrawal et al.
2011/0132620 A1 6/2011 Agrawal et al.
2011/0135530 A1 6/2011 Xu et al.
2011/0135805 A1 6/2011 Doucet et al.
2011/0135953 A1 6/2011 Xu et al.
2011/0136707 A1 6/2011 Xu et al.

FOREIGN PATENT DOCUMENTS

JP 2000185725 7/2000
JP 2004225084 8/2004
JP 2004225765 A 8/2004
JP 2005076052 A 3/2005
WO 2008/057045 A1 5/2008
WO W02008079485 7/2008

OTHER PUBLICATIONS

Baker Hughes Tools. "Baker Oil Tools Introduces Revolutionary Sand Control Completion Technology," May 2, 2005.

E. Paul Bercegeay et al., "A One-Trip Gravel Packing System"; Society of Petroleum Engineers, Offshort Technology Conference, SPE Paper No. 4771; Feb. 7-8, 1974.

Bybee, Karen. "One-Trip Completion System Eliminates Perforations," Completions Today, Sep. 2007, pp. 52-53.

Curtin, William and Brian Sheldon. "CNT-reinforced ceramics and metals," Materials Today, 2004, vol. 7, 44-49.

Galanty et al. "Consolidation of metal powders during the extrusion process," Journal of Materials Processing Technology (2002), pp. 491-496.

Hjortstam et al. "Can we achieve ultra-low resistivity in carbon nanotube-based metal composites," Applied Physics A (2004), vol. 78, Issue 8, pp. 1175-1179. [Abstract Only].

Notification of Transmittal of the International Search Report and the Written Opinion of the International Searching Authority; PCT/US2010/059259; International Searching Authority KIPO; Mailed Jun. 13, 2010.

Notification of Transmittal of the International Search Report and the Written Opinion of the International Searching Authority; PCT/US2010/059265; International Searching Authority KIPO; Mailed Jun. 16, 2011.

Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.

Song, G. and S. Song. "A Possible Biodegradable Magnesium Implant Material," Advanced Engineering Materials, vol. 9, Issue 4, Apr. 2007, pp. 298-302. [Abstract Only].

Zeng et al. "Progress and Challenge for Magnesium Alloys as Biomaterials," Advanced Engineering Materials, vol. 10, Issue 8, Aug. 2008, pp. B3-B14. [Abstract Only].

Notification of Transmittal of the International Search Report and the Written Opinion of the International Searching Authority; PCT/US2010/059257; Korean Intellectual Property Office; Mailed Jul. 27, 2011.

Notification of Transmittal of the International Search Report and the Written Opinion of the International Searching Authority; PCT/US2010/059268; International Searching Authority KIPO; Mailed Jun. 17, 2011.

Pardo, et al.; "Corrosion Behaviour of Magnesium/Aluminium Alloys in 3.5 wt% NaC1"; Corrosion Science; 50; pp. 823-834; (2008).
Notification of Transmittal of the International Search Report and Written Opinion, Mailed Jul. 8, 2011, International Appln. No. PCT/US2010/059263, Written Opinion 4 Pages, International Search Report 3 Pages.
Song, et al.; "Understanding Magnesium Corrosion"; Advanced Engineering Materials; 5; No. 12; pp. 837-858; (2003).
Abdoulaye Seyni, Nadine Le Bolay, Sonia Molina-Boisseau, "On the interest of using degradable fillers in co-ground composite materials", Powder Technology 190, (2009) pp. 176-184.
Ch. Christoglou, N. Voudouris, G.N. Angelopoulos, M. Pant, W. Dahl, "Deposition of Aluminum on Magnesium by a CVD Process", Surface and Coatings Technology 184 (2004) 149-155.
Constantin Vahlas, Brigitte Caussat, Philippe Serp, George N. Angelopoulos, "Principles and Applications of CVD Powder Technology", Materials Sciene and Engineering R 53 (2006) 1-72.
Guan Ling Song, Andrej Atrens "Corrosion Mechanisms of Magnesium Alloys", Advanced Engineering Materials 1999, 1, No. 1, pp. 11-33.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
J. Dutta Majumdar, B. Ramesh Chandra, B.L. Mordike, R. Galun, I. Manna, "Laser Surface Engineering of a Magnesium Alloy with Al + Al2O3", Surface and Cotaings Technology 179 (2004) 297-305.
J.E. Gray, B. Luan, "Protective Coatings on Magnesuim and Its Alloys—a Critical Review", Journal of Alloys and Compounds 336 (2002) 88-113.
Yihua Zhu, Chunzhong Li, Qiufang Wu, "The process of coating on ultrafine particles by surface hydrolysis reaction in a fluidized bed reactor", Surface and Coatings Technology 135 (2000) 14-17.
Notification of Transmittal of the International Search Report and the Written Opinion of the International Searching Authority; PCT/US2011/047000; Korean Intellectual Property Office; Mailed Dec. 26, 2011; 8 pages.
Yi Feng, Hailong Yuan, "Electroless Plating of Carbon Nanotubes with Silver" Journal fo Materials Science, 39, (2004) pp. 3241-3243.
E. Flahaut et al., "Carbon Nanotube-Metal-Oxide Nanocomposites: Microstructure, Electrical Conductivity and Mechanical Properties" Acta amter. 48 (2000) 3803-3812.
C.S. Goh, J. Wei, L C Lee, and M. Gupta, "Development of novel carbon nanotube reinforced magnesium nanocomposites using the powder metallurgy technique", Nanottechnology 17 (2006) 7-12.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.
Shimizu et al., "Multi-walled carbon nanotube-reinforced magnesium alloy composites", Scripta Materialia, vol. 58, Issue 4, pp. 267-270.
Jing Sun, Lian Gao, Wei Li, "Colloidal Processing fo Carbon Nanotube/Alumina Composites" Chem. Mater. 2002, 14, 5169-5172.
Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.
Y. Zhang and Hongjie Dai, "Formation of metal nanowires on suspended single-walled carbon nanotubes" Applied Physics Letter, vol. 77, No. 19 (2000), pp. 3015-3017.
Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.
Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

* cited by examiner

TELESCOPIC UNIT WITH DISSOLVABLE BARRIER

CROSS REFERENCE TO RELATED APPLICATIONS

This application contains subject matter related to the subject matter of co-pending applications, which are assigned to the same assignee as this application, Baker Hughes Incorporated of Houston, Tex. and are all being filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,686, entitled COATED METALLIC POWDER AND METHOD OF MAKING THE SAME;

U.S. patent application Ser. No. 12/633,688, entitled METHOD OF MAKING A NANOMATRIX POWDER METAL COMPACT;

U.S. patent application Ser. No. 12/633,678, entitled ENGINEERED POWDER COMPACT COMPOSITE MATERIAL;

U.S. patent application Ser. No. 12/633,677, entitled TELESCOPIC UNIT WITH DISSOLVABLE BARRIER;

U.S. patent application Ser. No. 12/633,662, entitled DISSOLVING TOOL AND METHOD; and U.S. patent application Ser. No. 12/633,688, entitled DISSOLVING TOOL AND METHOD.

BACKGROUND

In the downhole drilling and completion arts, completion strings are configured with many varied construction strategies to promote many different types of properties. One type of completion string employs radially telescopic members that allow for a direct opening connection to the formation face from the inside dimension of the completion string. Such telescopic members are useful for operations such as focused fracing operations and for production directly through the members.

Telescopic members of the prior art have been deployed using mechanical means and pressure. Where pressure is the motive force behind moving the telescopic members radially outwardly, the opening in the members must be initially closed for pressure to build thereupon. Commonly the art has used burst disks since they can be configured to burst at a certain pressure and leave little residue. Unfortunately however, although it would appear that regulated pressure would facilitate positive and complete deployment of the telescopic units, in practice this is not always the case. Rather, due to unpredictable borehole conditions, some of the telescopic members may not fully deploy before the pressure gets to the threshold pressure of the burst disks. This will result in at least one of the disks rupturing. Because the system is pressurized all at once, a single disk bursting will be sufficient to lose all the pressure to the formation and hence have no residual pressure available for the further deployment of telescopic members not fully deployed before the first disk ruptures. With the popularity of telescopic members increasing due to the benefits they provide if fully deployed, the art will well receive new configurations promising greater reliability of deployment.

SUMMARY

Disclosed herein is a telescopic member. The member includes at least a central component and a barrier disposed within the central component, the barrier has a selectively tailorable dissolution rate curve and has structural properties enabling the containment of high pressure prior to structural failure of the barrier through dissolution.

Further disclosed herein is a telescopic member. The member includes at least a central component, and a barrier disposed within the central component, the barrier has a selectively tailorable material yield strength.

BRIEF DESCRIPTION OF DRAWINGS

Referring now to the drawings wherein like elements are numbered alike in the several Figures.

DETAILED DESCRIPTION

Figure 1:
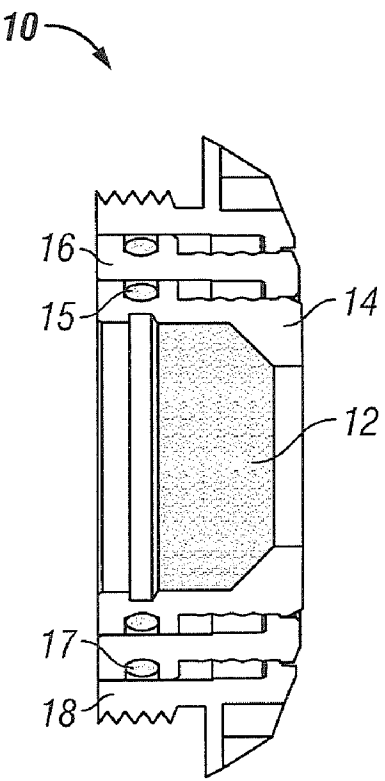
FIG. 1 is a cross sectional schematic view of a telescopic member having a barrier in a run in position.

Referring to FIG. 1, a telescopic member 10 having a dissolvable barrier 12 is illustrated in a run in position. Each telescopic member comprises at least a central tubular telescopic component 14 but can include more concentric components as desired. As illustrated, the telescopic member includes three components. The component 14 includes a seal 15 therearound, which in one embodiment is an o-ring. The o-ring ensures that the component 14 will seal with a middle component 16. The middle component 16 similarly is endowed with a seal 17 as well, that also may be an o-ring and which is to ensure a seal with a base 18. The base 18 is fixedly connected to a completion string not shown by for example a threaded connection or a welded connection, etc. Further, it is to be noted that although the telescoping components number three as illustrated, there is no reason that more components cannot be employed to extend a radial reach of the telescopic member 10 providing the either the base is diametrically larger than shown or the final inside dimension flow area of the resulting central component is smaller.

It is to be understood that while a single telescopic member is illustrated, one or more of these members may be employed in various embodiments hereof. In each case, however, the barrier 12 is employed. Barrier 12 is structurally capable of withstanding very high pressures for a long enough period of time to ensure that all telescopic members 10 are indeed appropriately deployed. The barrier 12 will then dissolve based upon exposure to a fluid in contact therewith. The fluid may be a natural borehole fluid such as water, oil, etc. or may be a fluid added to the borehole for the specific purpose of dissolving the barriers 12 or for another purpose with an ancillary purpose of dissolving the barrier 12. Barrier 12 may be constructed of a number of materials that are dissolvable but one embodiment in particular utilizes a high strength dissolvable magnesium based material having a selectively tailorable dissolution rate curve and or yield strength. The material itself is discussed in detail later in this disclosure. This material exhibits exceptional strength while intact and will yet easily dissolves in a controlled and selectively short time frame. The material is dissolvable in water, water-based mud, downhole brines or acid, for example, and can be configured for a dissolution rate as desired. In addition, surface irregularities to increase a surface area of the barrier 12 that is exposed to the dissolution fluid such as grooves, corrugations, depressions, etc. may be used. Upon complete dissolution of the barrier 12, the telescopic member is left completely open and unobstructed. Because the material disclosed above can be tailored to completely dissolve in about 4 to 10 minutes, the telescopic members are virtually immediately available in an unobstructed condition. Because prior to dissolution, the barriers are exceptionally strong, a great amount of pressure, for example, about 3000 psi-about 5000 psi may be placed upon the tubing string to cause deployment of the telescopic members ensuring a full deployment. Because the material will thence rapidly dissolve, the telescopic members will be relatively immediately available for whatever function is required of them.

As introduced above, further materials may be utilized with the ball as described herein are lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 4:
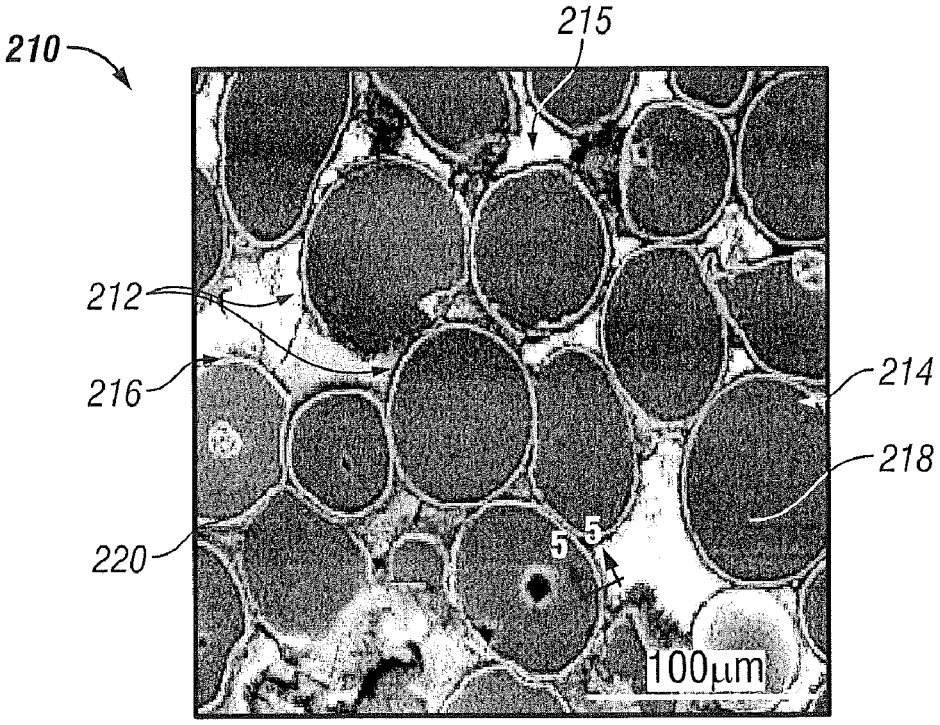
FIG. 4 is a photomicrograph of a powder 210 as disclosed herein that has been embedded in a potting material and sectioned.

Referring to FIG. 4, a metallic powder 210 includes a plurality of metallic, coated powder particles 212. Powder particles 212 may be formed to provide a powder 210, including free-flowing powder, that may be poured or otherwise disposed in all manner of forms or molds (not shown) having all manner of shapes and sizes and that may be used to fashion precursor powder compacts and powder compacts 400 (FIGS. 6 and 7), as described herein, that may be used as, or for use in manufacturing, various articles of manufacture, including various wellbore tools and components.

Each of the metallic, coated powder particles 212 of powder 210 includes a particle core 214 and a metallic coating layer 216 disposed on the particle core 214. The particle core 214 includes a core material 218. The core material 218 may include any suitable material for forming the particle core 214 that provides powder particle 212 that can be sintered to form a lightweight, high-strength powder compact 400 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 218 may also include other metals that are less electrochemically active than Zn or non-metallic materials, or a combination thereof. Suitable non-metallic materials include ceramics, composites, glasses or carbon, or a combination thereof. Core material 218 may be selected to provide a high dissolution rate in a predetermined wellbore fluid, but may also be selected to provide a relatively low dissolution rate, including zero dissolution, where dissolution of the nanomatrix material causes the particle core 214 to be rapidly undermined and liberated from the particle compact at the interface with the wellbore fluid, such that the effective rate of dissolution of particle compacts made using particle cores 214 of these core materials 218 is high, even though core material 218 itself may have a low dissolution rate, including core materials 220 that may be substantially insoluble in the wellbore fluid.

With regard to the electrochemically active metals as core materials 218, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 218 may also include other constituents, including various alloying additions, to alter one or more properties of the particle cores 214, such as by improving the strength, lowering the density or altering the dissolution characteristics of the core material 218.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 214 and core material 218, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 214 and core material 218 have a melting temperature ($T_P$). As used herein, $T_P$ includes the lowest temperature at which incipient melting or liquation or other forms of partial melting occur within core material 218, regardless of whether core material 218 comprises a pure metal, an alloy with multiple phases having different melting temperatures or a composite of materials having different melting temperatures.

Particle cores 214 may have any suitable particle size or range of particle sizes or distribution of particle sizes. For example, the particle cores 214 may be selected to provide an average particle size that is represented by a normal or Gaussian type unimodal distribution around an average or mean, as illustrated generally in FIG. 4. In another example, particle cores 214 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 215 of the particles 212 of powder 210. In an exemplary embodiment, the particle cores 214 may have a unimodal distribution and an average particle diameter of about 5 μm to about 300 μm, more particularly about 80 μm to about 120 μm, and even more particularly about 100 μm.

Particle cores 214 may have any suitable particle shape, including any regular or irregular geometric shape, or combination thereof. In an exemplary embodiment, particle cores 214 are substantially spheroidal electrochemically active metal particles. In another exemplary embodiment, particle cores 214 are substantially irregularly shaped ceramic particles. In yet another exemplary embodiment, particle cores 214 are carbon or other nanotube structures or hollow glass microspheres.

Each of the metallic, coated powder particles 212 of powder 210 also includes a metallic coating layer 216 that is disposed on particle core 214. Metallic coating layer 216 includes a metallic coating material 220. Metallic coating material 220 gives the powder particles 212 and powder 210 its metallic nature. Metallic coating layer 216 is a nanoscale coating layer. In an exemplary embodiment, metallic coating layer 216 may have a thickness of about 25 nm to about 2500 nm. The thickness of metallic coating layer 216 may vary over the surface of particle core 214, but will preferably have a substantially uniform thickness over the surface of particle core 214. Metallic coating layer 216 may include a single layer, as illustrated in FIG. 4, or a plurality of layers as a multilayer coating structure. In a single layer coating, or in each of the layers of a multilayer coating, the metallic coating layer 216 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 216, each of the respective layers, or combinations of them, may be used to provide a predetermined property to the powder particle 212 or a sintered powder compact formed therefrom. For example, the predetermined property may include the bond strength of the metallurgical bond between the particle core 214 and the coating material 220; the interdiffusion characteristics between the particle core 214 and metallic coating layer 216, including any interdiffusion between the layers of a multilayer coating layer 216; the interdiffusion characteristics between the various layers of a multilayer coating layer 216; the interdiffusion characteristics between the metallic coating layer 216 of one powder particle and that of an adjacent powder particle 212; the bond strength of the metallurgical bond between the metallic coating layers of adjacent sintered powder particles 212, including the outermost layers of multilayer coating layers; and the electrochemical activity of the coating layer 216.

Metallic coating layer 216 and coating material 220 have a melting temperature ($T_C$). As used herein, $T_C$ includes the lowest temperature at which incipient melting or liquation or other forms of partial melting occur within coating material 220, regardless of whether coating material 220 comprises a pure metal, an alloy with multiple phases each having different melting temperatures or a composite, including a composite comprising a plurality of coating material layers having different melting temperatures.

Metallic coating material 220 may include any suitable metallic coating material 220 that provides a sinterable outer surface 221 that is configured to be sintered to an adjacent powder particle 212 that also has a metallic coating layer 216 and sinterable outer surface 221. In powders 210 that also include second or additional (coated or uncoated) particles 232, as described herein, the sinterable outer surface 221 of metallic coating layer 216 is also configured to be sintered to a sinterable outer surface 221 of second particles 232. In an exemplary embodiment, the powder particles 212 are sinterable at a predetermined sintering temperature ($T_S$) that is a function of the core material 218 and coating material 220, such that sintering of powder compact 400 is accomplished entirely in the solid state and where $T_S$ is less than $T_P$ and $T_C$. Sintering in the solid state limits particle core 214/metallic coating layer 416 interactions to solid state diffusion processes and metallurgical transport phenomena and limits growth of and provides control over the resultant interface between them. In contrast, for example, the introduction of liquid phase sintering would provide for rapid interdiffusion of the particle core 214/metallic coating layer 216 materials and make it difficult to limit the growth of and provide control over the resultant interface between them, and thus interfere with the formation of the desirable microstructure of particle compact 400 as described herein.

In an exemplary embodiment, core material 218 will be selected to provide a core chemical composition and the coating material 220 will be selected to provide a coating chemical composition and these chemical compositions will also be selected to differ from one another. In another exemplary embodiment, the core material 218 will be selected to provide a core chemical composition and the coating material 220 will be selected to provide a coating chemical composition and these chemical compositions will also be selected to differ from one another at their interface. Differences in the chemical compositions of coating material 220 and core material 218 may be selected to provide different dissolution rates and selectable and controllable dissolution of powder compacts 400 that incorporate them making them selectably and controllably dissolvable. This includes dissolution rates that differ in response to a changed condition in the wellbore, including an indirect or direct change in a wellbore fluid. In an exemplary embodiment, a powder compact 400 formed from powder 210 having chemical compositions of core material 218 and coating material 220 that make compact 400 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 3:
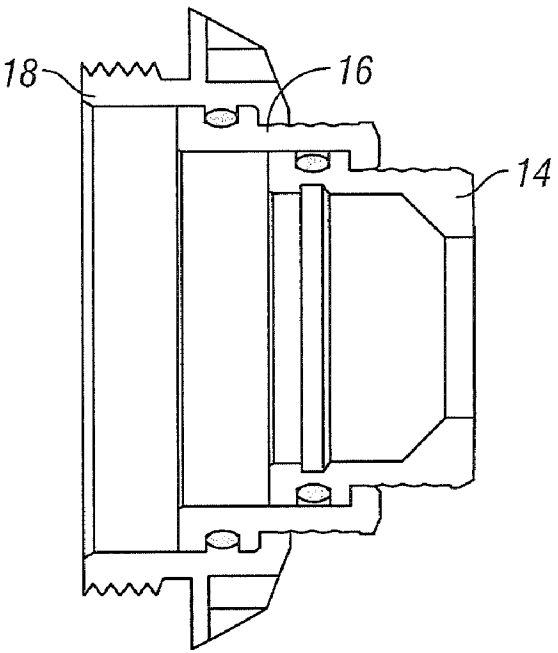
FIG. 3 is a cross sectional view of the member of FIG. 1 in a deployed and open position.
Figure 2:
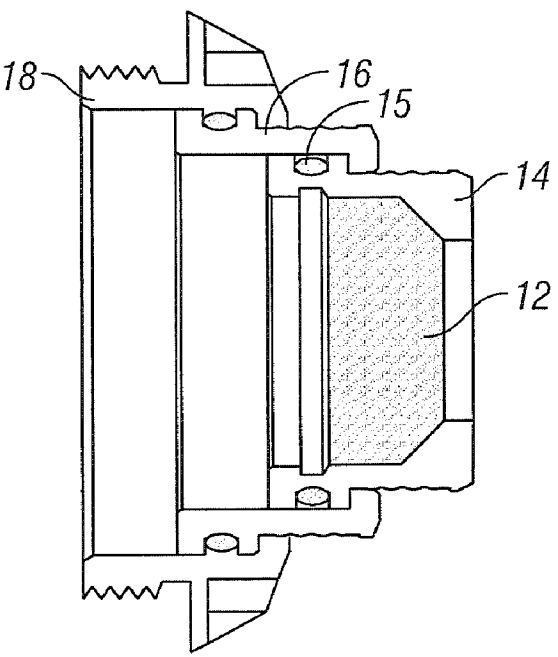
FIG. 2 is a cross sectional schematic view of the member of FIG. 1 in a deployed position.
Figure 5:
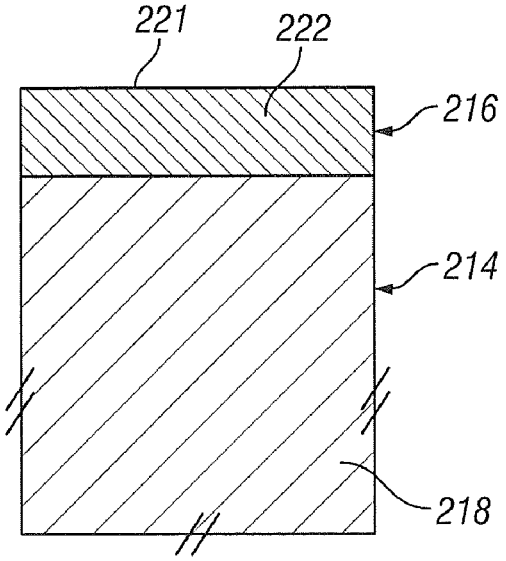
FIG. 5 is a schematic illustration of an exemplary embodiment of a powder particle 212 as it would appear in an exemplary section view represented by section 5-5 of FIG. 4.

As illustrated in FIGS. 3 and 5, particle core 214 and core material 218 and metallic coating layer 216 and coating material 220 may be selected to provide powder particles 212 and a powder 210 that is configured for compaction and sintering to provide a powder compact 400 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 400 includes a substantially-continuous, cellular nanomatrix 416 of a nanomatrix material 420 having a plurality of dispersed particles 414 dispersed throughout the cellular nanomatrix 416. The substantially-continuous cellular nanomatrix 416 and nanomatrix material 420 formed of sintered metallic coating layers 216 is formed by the compaction and sintering of the plurality of metallic coating layers 216 of the plurality of powder particles 212. The chemical composition of nanomatrix material 420 may be different than that of coating material 220 due to diffusion effects associated with the sintering as described herein. Powder metal compact 400 also includes a plurality of dispersed particles 414 that comprise particle core material 418. Dispersed particle cores 414 and core material 418 correspond to and are formed from the plurality of particle cores 214 and core material 218 of the plurality of powder particles 212 as the metallic coating layers 216 are sintered together to form nanomatrix 416. The chemical composition of core material 418 may be different than that of core material 218 due to diffusion effects associated with sintering as described herein.

As used herein, the use of the term substantially-continuous cellular nanomatrix 416 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 420 within powder compact 400. As used herein, "substantially-continuous" describes the extension of the nanomatrix material throughout powder compact 400 such that it extends between and envelopes substantially all of the dispersed particles 414. Substantially-continuous is used to indicate that complete continuity and regular order of the nanomatrix around each dispersed particle 414 is not required. For example, defects in the coating layer 216 over particle core 214 on some powder particles 212 may cause bridging of the particle cores 214 during sintering of the powder compact 400, thereby causing localized discontinuities to result within the cellular nanomatrix 416, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 420 that encompass and also interconnect the dispersed particles 414. As used herein, "nanomatrix" is used to describe the size or scale of the matrix, particularly the thickness of the matrix between adjacent dispersed particles 414. The metallic coating layers that are sintered together to form the nanomatrix are themselves nanoscale thickness coating layers. Since the nanomatrix at most locations, other than the intersection of more than two dispersed particles 414, generally comprises the interdiffusion and bonding of two coating layers 216 from adjacent powder particles 212 having nanoscale thicknesses, the matrix formed also has a nanoscale thickness (e.g., approximately two times the coating layer thickness as described herein) and is thus described as a nanomatrix. Further, the use of the term dispersed particles 414 does not connote the minor constituent of powder compact 400, but rather refers to the majority constituent or constituents, whether by weight or by volume. The use of the term dispersed particle is intended to convey the discontinuous and discrete distribution of particle core material 418 within powder compact 400.

Powder compact 400 may have any desired shape or size, including that of a cylindrical billet or bar that may be machined or otherwise used to form useful articles of manufacture, including various wellbore tools and components. The pressing used to form precursor powder compact and sintering and pressing processes used to form powder compact 400 and deform the powder particles 212, including particle cores 214 and coating layers 216, to provide the full density and desired macroscopic shape and size of powder compact 400 as well as its microstructure. The microstructure of powder compact 400 includes an equiaxed configuration of dispersed particles 414 that are dispersed throughout and embedded within the substantially-continuous, cellular nanomatrix 416 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 416 of sintered metallic coating layers 216 may be produced using constituents where thermodynamic phase equilibrium conditions would not produce an equiaxed structure. The equiaxed morphology of the dispersed particles 414 and cellular network 416 of particle layers results from sintering and deformation of the powder particles 212 as they are compacted and interdiffuse and deform to fill the interparticle spaces 215 (FIG. 4). The sintering temperatures and pressures may be selected to ensure that the density of powder compact 400 achieves substantially full theoretical density.

Figure 6:
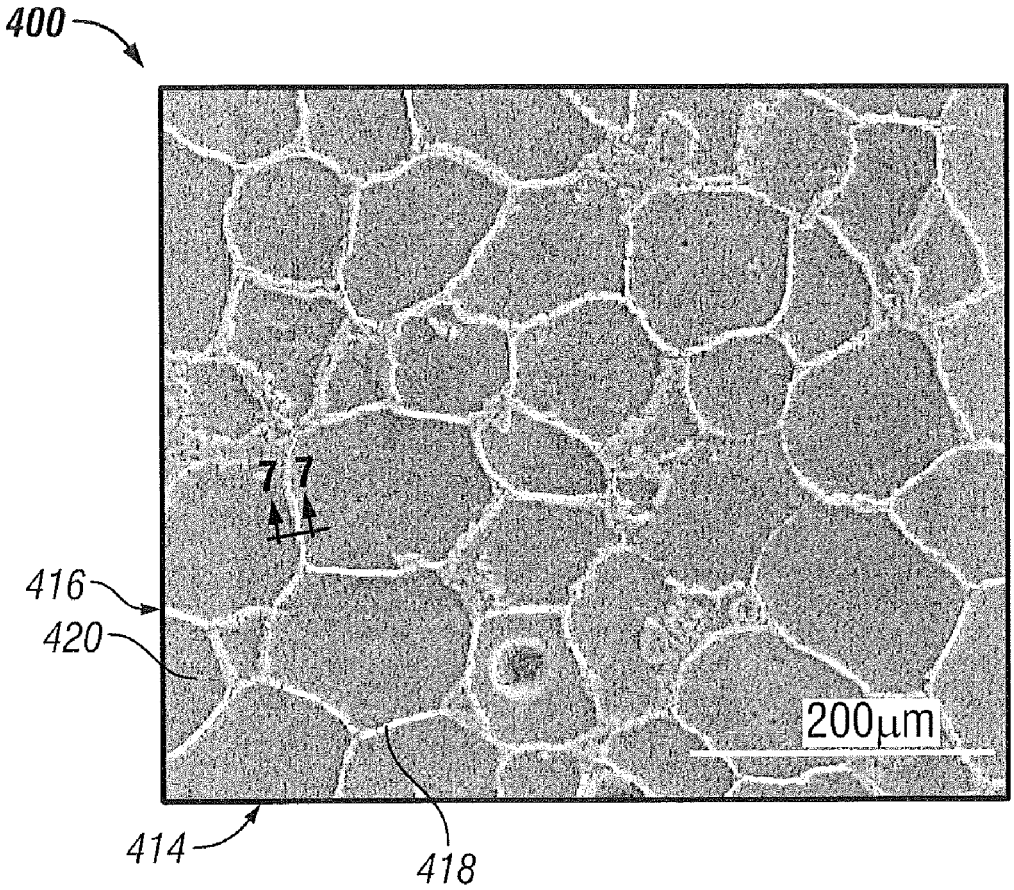
FIG. 6 is a photomicrograph of an exemplary embodiment of a powder compact as disclosed herein.
Figure 7:
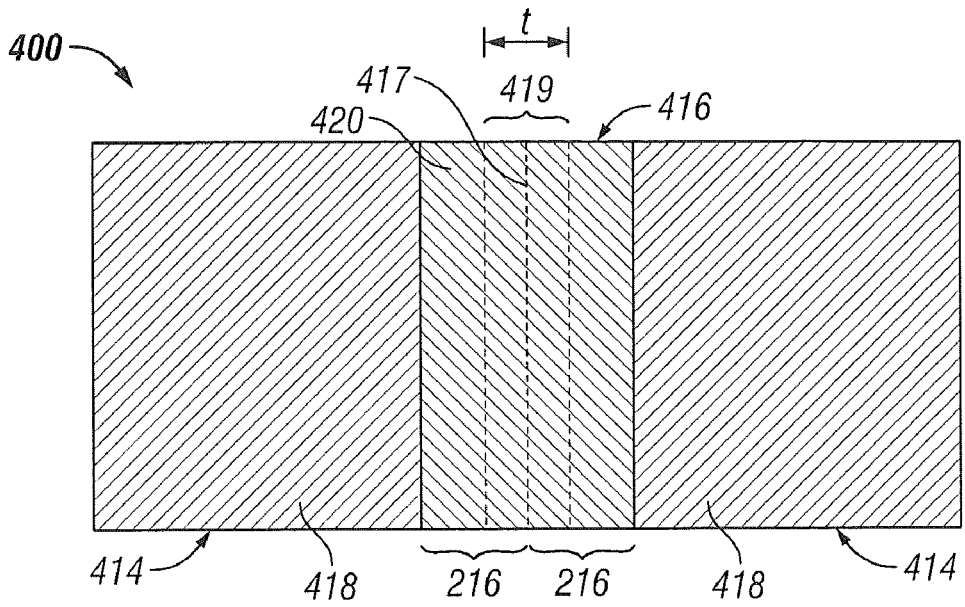
FIG. 7 is a schematic of illustration of an exemplary embodiment of the powder compact of FIG. 6 made using a powder having single-layer powder particles as it would appear taken along section 7-7.
Figure 8:
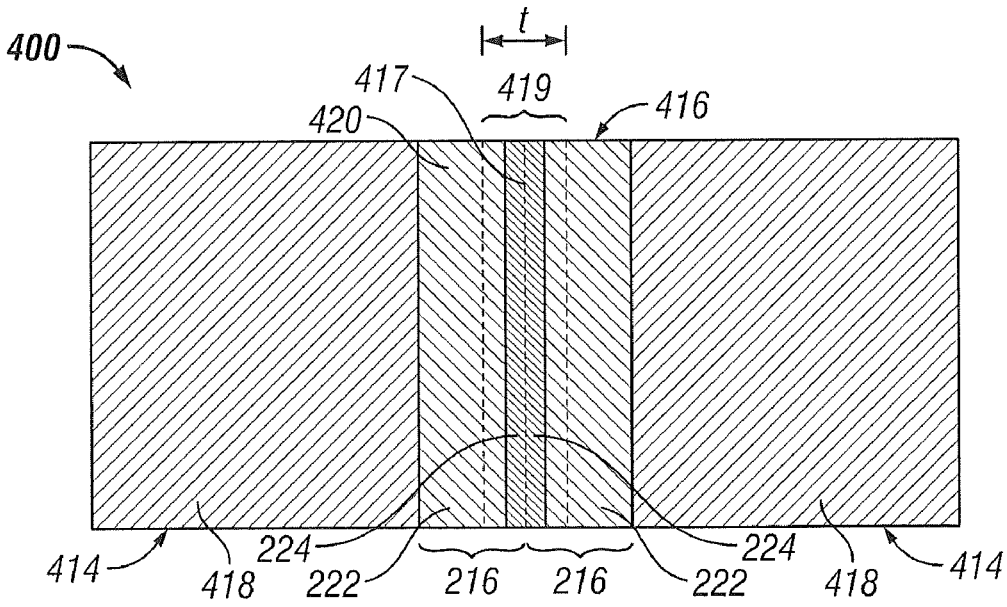
FIG. 8 is a schematic of illustration of another exemplary embodiment of the powder compact of FIG. 6 made using a powder having multilayer powder particles as it would appear taken along section 7-7.
Figure 9:
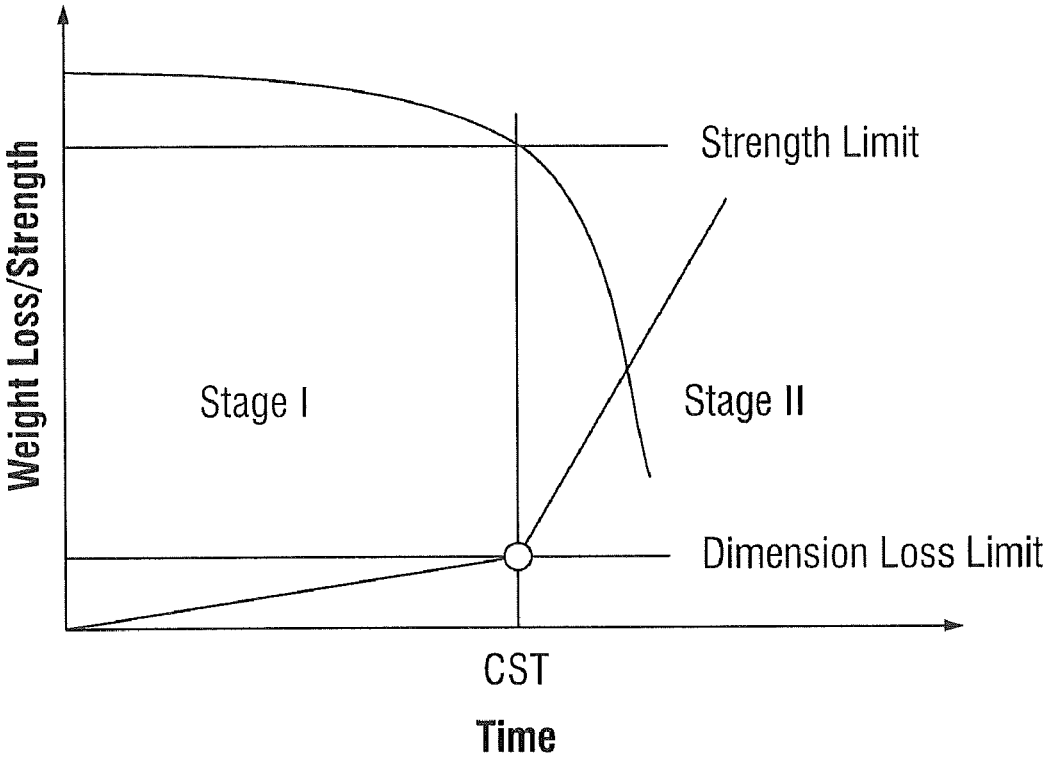
FIG. 9 is a schematic illustration of a change in a property of a powder compact as disclosed herein as a function of time and a change in condition of the powder compact environment.

In an exemplary embodiment as illustrated in FIGS. 4, 5, and 6, dispersed particles 414 are formed from particle cores 214 dispersed in the cellular nanomatrix 416 of sintered metallic coating layers 216, and the nanomatrix 416 includes a solid-state metallurgical bond 417 or bond layer 419, as illustrated schematically in FIGS. 7 and 8, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 216 of adjacent powder particles 212 that are compressed into touching contact during the compaction and sintering processes used to form powder compact 400, as described herein. As such, sintered coating layers 216 of cellular nanomatrix 416 include a solid-state bond layer 419 that has a thickness (t) defined by the extent of the interdiffusion of the coating materials 220 of the coating layers 216, which will in turn be defined by the nature of the coating layers 216, including whether they are single or multilayer coating layers, whether they have been selected to promote or limit such interdiffusion, and other factors, as described herein, as well as the sintering and compaction conditions, including the sintering time, temperature and pressure used to form powder compact 400.

In an exemplary embodiment as illustrated in FIGS. 3 and 5, dispersed particles 414 are formed from particle cores 214 dispersed in the cellular nanomatrix 416 of sintered metallic coating layers 216, and the nanomatrix 416 includes a solid-state metallurgical bond 417 or bond layer 419, as illustrated schematically in FIG. 6, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 216 of adjacent powder particles 212 that are compressed into touching contact during the compaction and sintering processes used to form powder compact 400, as described herein. As such, sintered coating layers 216 of cellular nanomatrix 416 include a solid-state bond layer 419 that has a thickness (t) defined by the extent of the interdiffusion of the coating materials 220 of the coating layers 216, which will in turn be defined by the nature of the coating layers 216, including whether they are single or multilayer coating layers, whether they have been selected to promote or limit such interdiffusion, and other factors, as described herein, as well as the sintering and compaction conditions, including the sintering time, temperature and pressure used to form powder compact 400.

As nanomatrix 416 is formed, including bond 417 and bond layer 419, the chemical composition or phase distribution, or both, of metallic coating layers 216 may change. Nanomatrix 416 also has a melting temperature ($T_M$). As used herein, $T_M$ includes the lowest temperature at which incipient melting or liquation or other forms of partial melting will occur within nanomatrix 416, regardless of whether nanomatrix material 420 comprises a pure metal, an alloy with multiple phases each having different melting temperatures or a composite, including a composite comprising a plurality of layers of various coating materials having different melting temperatures, or a combination thereof, or otherwise. As dispersed particles 414 and particle core materials 418 are formed in conjunction with nanomatrix 416, diffusion of constituents of metallic coating layers 216 into the particle cores 214 is also possible, which may result in changes in the chemical composition or phase distribution, or both, of particle cores 214. As a result, dispersed particles 414 and particle core materials 418 may have a melting temperature ($T_{DP}$) that is different than $T_P$. As used herein, $T_{DP}$ includes the lowest temperature at which incipient melting or liquation or other forms of partial melting will occur within dispersed particles 414, regardless of whether particle core material 418 comprise a pure metal, an alloy with multiple phases each having different melting temperatures or a composite, or otherwise. Powder compact 400 is formed at a sintering temperature ($T_S$), where $T_S$ is less than $T_C$, $T_P$, $T_M$ and $T_{DP}$.

Dispersed particles 414 may comprise any of the materials described herein for particle cores 214, even though the chemical composition of dispersed particles 414 may be different due to diffusion effects as described herein. In an exemplary embodiment, dispersed particles 414 are formed from particle cores 214 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 214. Of these materials, those having dispersed particles 414 comprising Mg and the nanomatrix 416 formed from the metallic coating materials 216 described herein are particularly useful. Dispersed particles 414 and particle core material 418 of Mg, Al, Zn or Mn, or a combination thereof, may also include a rare earth element, or a combination of rare earth elements as disclosed herein in conjunction with particle cores 214.

In another exemplary embodiment, dispersed particles 414 are formed from particle cores 214 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 414 of powder compact 400 may have any suitable particle size, including the average particle sizes described herein for particle cores 214.

Dispersed particles 214 may have any suitable shape depending on the shape selected for particle cores 214 and powder particles 212, as well as the method used to sinter and compact powder 210. In an exemplary embodiment, powder particles 212 may be spheroidal or substantially spheroidal and dispersed particles 414 may include an equiaxed particle configuration as described herein.

The nature of the dispersion of dispersed particles 414 may be affected by the selection of the powder 210 or powders 210 used to make particle compact 400. In one exemplary embodiment, a powder 210 having a unimodal distribution of powder particle 212 sizes may be selected to form powder compact 400 and will produce a substantially homogeneous unimodal dispersion of particle sizes of dispersed particles 414 within cellular nanomatrix 416, as illustrated generally in FIG. 5. In another exemplary embodiment, a plurality of powders 210 having a plurality of powder particles with particle cores 214 that have the same core materials 218 and different core sizes and the same coating material 220 may be selected and uniformly mixed as described herein to provide a powder 210 having a homogenous, multimodal distribution of powder particle 212 sizes, and may be used to form powder compact 400 having a homogeneous, multimodal dispersion of particle sizes of dispersed particles 414 within cellular nanomatrix 416. Similarly, in yet another exemplary embodiment, a plurality of powders 210 having a plurality of particle cores 214 that may have the same core materials 218 and different core sizes and the same coating material 220 may be selected and distributed in a non-uniform manner to provide a non-homogenous, multimodal distribution of powder particle sizes, and may be used to form powder compact 400 having a non-homogeneous, multimodal dispersion of particle sizes of dispersed particles 414 within cellular nanomatrix 416. The selection of the distribution of particle core size may be used to determine, for example, the particle size and interparticle spacing of the dispersed particles 414 within the cellular nanomatrix 416 of powder compacts 400 made from powder 210.

Nanomatrix 416 is a substantially-continuous, cellular network of metallic coating layers 216 that are sintered to one another. The thickness of nanomatrix 416 will depend on the nature of the powder 210 or powders 210 used to form powder compact 400, as well as the incorporation of any second powder 230, particularly the thicknesses of the coating layers associated with these particles. In an exemplary embodiment, the thickness of nanomatrix 416 is substantially uniform throughout the microstructure of powder compact 400 and comprises about two times the thickness of the coating layers 216 of powder particles 212. In another exemplary embodiment, the cellular network 416 has a substantially uniform average thickness between dispersed particles 414 of about 50 nm to about 5000 nm.

Nanomatrix 416 is formed by sintering metallic coating layers 216 of adjacent particles to one another by interdiffusion and creation of bond layer 419 as described herein. Metallic coating layers 216 may be single layer or multilayer structures, and they may be selected to promote or inhibit diffusion, or both, within the layer or between the layers of metallic coating layer 216, or between the metallic coating layer 216 and particle core 214, or between the metallic coating layer 216 and the metallic coating layer 216 of an adjacent powder particle, the extent of interdiffusion of metallic coating layers 216 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 416 and nanomatrix material 420 may be simply understood to be a combination of the constituents of coating layers 216 that may also include one or more constituents of dispersed particles 414, depending on the extent of interdiffusion, if any, that occurs between the dispersed particles 414 and the nanomatrix 416. Similarly, the chemical composition of dispersed particles 414 and particle core material 418 may be simply understood to be a combination of the constituents of particle core 214 that may also include one or more constituents of nanomatrix 416 and nanomatrix material 420, depending on the extent of interdiffusion, if any, that occurs between the dispersed particles 414 and the nanomatrix 416.

In an exemplary embodiment, the nanomatrix material 420 has a chemical composition and the particle core material 418 has a chemical composition that is different from that of nanomatrix material 420, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 400, including a property change in a wellbore fluid that is in contact with the powder compact 400, as described herein. Nanomatrix 416 may be formed from powder particles 212 having single layer and multilayer coating layers 216. This design flexibility provides a large number of material combinations, particularly in the case of multilayer coating layers 216, that can be utilized to tailor the cellular nanomatrix 416 and composition of nanomatrix material 420 by controlling the interaction of the coating layer constituents, both within a given layer, as well as between a coating layer 216 and the particle core 214 with which it is associated or a coating layer 216 of an adjacent powder particle 212. Several exemplary embodiments that demonstrate this flexibility are provided below.

As illustrated in FIG. 6, in an exemplary embodiment, powder compact 400 is formed from powder particles 212 where the coating layer 216 comprises a single layer, and the resulting nanomatrix 416 between adjacent ones of the plurality of dispersed particles 414 comprises the single metallic coating layer 216 of one powder particle 212, a bond layer 419 and the single coating layer 216 of another one of the adjacent powder particles 212. The thickness (t) of bond layer 419 is determined by the extent of the interdiffusion between the single metallic coating layers 216, and may encompass the entire thickness of nanomatrix 416 or only a portion thereof. In one exemplary embodiment of powder compact 400 formed using a single layer powder 210, powder compact 400 may include dispersed particles 414 comprising Mg, Al, Zn or Mn, or a combination thereof, as described herein, and nanomatrix 216 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 420 of cellular nanomatrix 416, including bond layer 419, has a chemical composition and the core material 418 of dispersed particles 414 has a chemical composition that is different than the chemical composition of nanomatrix material 416. The difference in the chemical composition of the nanomatrix material 420 and the core material 418 may be used to provide selectable and controllable dissolution in response to a change in a property of a wellbore, including a wellbore fluid, as described herein. In a further exemplary embodiment of a powder compact 400 formed from a powder 210 having a single coating layer configuration, dispersed particles 414 include Mg, Al, Zn or Mn, or a combination thereof, and the cellular nanomatrix 416 includes Al or Ni, or a combination thereof.

As illustrated in FIG. 7, in another exemplary embodiment, powder compact 400 is formed from powder particles 212 where the coating layer 216 comprises a multilayer coating layer 216 having a plurality of coating layers, and the resulting nanomatrix 416 between adjacent ones of the plurality of dispersed particles 414 comprises the plurality of layers (t) comprising the coating layer 216 of one particle 212, a bond layer 419, and the plurality of layers comprising the coating layer 216 of another one of powder particles 212. In FIG. 7, this is illustrated with a two-layer metallic coating layer 216, but it will be understood that the plurality of layers of multilayer metallic coating layer 216 may include any desired number of layers. The thickness (t) of the bond layer 419 is again determined by the extent of the interdiffusion between the plurality of layers of the respective coating layers 216, and may encompass the entire thickness of nanomatrix 416 or only a portion thereof. In this embodiment, the plurality of layers comprising each coating layer 216 may be used to control interdiffusion and formation of bond layer 419 and thickness (t).

Sintered and forged powder compacts 400 that include dispersed particles 414 comprising Mg and nanomatrix 416 comprising various nanomatrix materials as described herein have demonstrated an excellent combination of mechanical strength and low density that exemplify the lightweight, high-strength materials disclosed herein. Examples of powder compacts 400 that have pure Mg dispersed particles 414 and various nanomatrices 416 formed from powders 210 having pure Mg particle cores 214 and various single and multilayer metallic coating layers 216 that include Al, Ni, W or $Al_2O_3$, or a combination thereof. These powders compacts 400 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 400 may also be configured to provide substantially enhanced properties as compared to powder compacts formed from pure Mg particles that do not include the nanoscale coatings described herein. Powder compacts 400 that include dispersed particles 414 comprising Mg and nanomatrix 416 comprising various nanomatrix materials 420 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 400 can be further improved by optimizing powder 210, particularly the weight percentage of the nanoscale metallic coating layers 216 that are used to form cellular nanomatrix 416. Strength of the nanomatrix powder metal compact 400 can be further improved by optimizing powder 210, particularly the weight percentage of the nanoscale metallic coating layers 216 that are used to form cellular nanomatrix 416. For example, varying the weight percentage (wt. %), i.e., thickness, of an alumina coating within a cellular nanomatrix 16 formed from coated powder particles 212 that include a multilayer ($Al/Al_2O_3/Al$) metallic coating layer 16 on pure Mg particle cores 214 provides an increase of 21% as compared to that of 0 wt % alumina.

Powder compacts 400 comprising dispersed particles 414 that include Mg and nanomatrix 416 that includes various nanomatrix materials as described herein have also demonstrated a room temperature sheer strength of at least about 20 ksi. This is in contrast with powder compacts formed from pure Mg powders, which have room temperature sheer strengths of about 8 ksi.

Powder compacts 400 of the types disclosed herein are able to achieve an actual density that is substantially equal to the predetermined theoretical density of a compact material based on the composition of powder 210, including relative amounts of constituents of particle cores 214 and metallic coating layer 216, and are also described herein as being fully-dense powder compacts. Powder compacts 400 comprising dispersed particles that include Mg and nanomatrix 416 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Powder compacts 400 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 400 comprising dispersed particles 414 that include Mg and cellular nanomatrix 416 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 216. An example of a changed condition comprising a change in chemical composition includes a change in a chloride ion concentration or pH value, or both, of the wellbore fluid. For example, powder compacts 400 comprising dispersed particles 414 that include Mg and nanomatrix 416 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 8, which illustrates that at a selected predetermined critical service time (CST) a changed condition may be imposed upon powder compact 400 as it is applied in a given application, such as a wellbore environment, that causes a controllable change in a property of powder compact 400 in response to a changed condition in the environment in which it is applied. For example, at a predetermined CST changing a wellbore fluid that is in contact with powder contact 400 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 400 as disclosed herein is no longer needed in service in the wellbore (e.g., the CST) the condition in the wellbore (e.g., the chloride ion concentration of the wellbore fluid) may be changed to cause the rapid dissolution of powder compact 400 and its removal from the wellbore. In the example described above, powder compact 400 is selectably dissolvable at a rate that ranges from about 0 to about 7000 $mg/cm^2/hr$. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 400 described herein and includes a cellular nanomatrix 416 of nanomatrix material 420, a plurality of dispersed particles 414 including particle core material 418 that is dispersed within the matrix. Nanomatrix 416 is characterized by a solid-state bond layer 419, which extends throughout the nanomatrix. The time in contact with the fluid described above may include the CST as described above. The CST may include a predetermined time that is desired or required to dissolve a predetermined portion of the powder compact 200 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 8.

Without being limited by theory, powder compacts 400 are formed from coated powder particles 212 that include a particle core 214 and associated core material 218 as well as a metallic coating layer 216 and an associated metallic coating material 220 to form a substantially-continuous, three-dimensional, cellular nanomatrix 416 that includes a nanomatrix material 420 formed by sintering and the associated diffusion bonding of the respective coating layers 216 that includes a plurality of dispersed particles 414 of the particle core materials 418. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 400, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 416, which may be selected to provide a strengthening phase material, with dispersed particles 414, which may be selected to provide equiaxed dispersed particles 414, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 400 made using uncoated pure Mg powder and subjected to a shear stress sufficient to induce failure demonstrated intergranular fracture. In contrast, a powder compact 400 made using powder particles 212 having pure Mg powder particle cores 214 to form dispersed particles 414 and metallic coating layers 216 that includes Al to form nanomatrix 416 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A telescopic member comprising:

at least a central component; and a barrier disposed within the central component, the barrier having a selectively tailorable corrosion rate curve and having structural properties enabling the containment of high pressure prior to structural failure of the barrier through corrosion, wherein the barrier is constructed of a powder compact that comprises:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid state bond layer extending throughout the cellular nanomatrix between the dispersed particles.

2. A telescopic member as claimed in claim 1 wherein the barrier comprises a selectively tailorable yield strength.

3. A telescopic member as claimed in claim 1, wherein the nanomatrix material has a melting temperature (TM), the particle core material has a melting temperature (TDP); wherein the powder compact is sinterable in a solid-state at a sintering temperature (TS), and TS is less than TM and TDP.

4. A telescopic member as claimed in claim 1, wherein the dispersed particles comprise Mg—Zn, Mg—Al, Mg—Mn, Mg—Zn—Y, Mg—Al—Si or Mg—Al—Zn.

5. A telescopic member as claimed in claim 1, wherein the dispersed particles comprise an Mg—Al—X alloy, wherein X comprises Zn, Mn, Si, Ca or Y, or a combination thereof.

6. A telescopic member as claimed in claim 1, wherein the dispersed particles further comprise a rare earth element.

7. A telescopic member as claimed in claim 1, wherein the dispersed particles have an average particle size of about 5 μm to about 300 μm.

8. A telescopic member as claimed in claim 1, wherein the dispersed particles have an equiaxed particle shape.

9. A telescopic member as claimed in claim 1, further comprising a plurality of dispersed second particles, wherein the dispersed second particles are also dispersed within the cellular nanomatrix and with respect to the dispersed particles.

10. A telescopic member as claimed in claim 9, wherein the dispersed second particles comprise Fe, Ni, Co or Cu, or oxides, nitrides or carbides thereof, or a combination comprising at least one of the foregoing elements, oxides, nitrides, or carbides.

11. A telescopic member as claimed in claim 1, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

12. A telescopic member as claimed in claim 1, wherein the cellular nanomatrix has an average thickness of about 100 nm to about 5 μm.

13. A telescopic member as claimed in claim 1, wherein the powder compact is formed from a sintered powder comprising a plurality of powder particles, each powder particle having a particle core that upon sintering comprises a dispersed particle and a single metallic coating layer disposed thereon, and wherein the cellular nanomatrix between adjacent ones of the plurality of dispersed particles comprises the single metallic coating layer of one powder particle, the bond layer and the single metallic coating layer of another of the powder particles.

14. A telescopic member as claimed in claim 1, wherein the powder compact is formed from a sintered powder comprising a plurality of powder particles, each powder particle having a particle core that upon sintering comprises a dispersed particle and a plurality of metallic coating layers disposed thereon, and wherein the cellular nanomatrix between adjacent ones of the plurality of dispersed particles comprises the plurality of metallic coating layers of one powder particle, the bond layer and plurality of metallic coating layers of another of the powder particles, and wherein adjacent ones of the plurality of metallic coating layers have different chemical compositions.

15. A telescopic member as claimed in claim 1, wherein the dispersed particles comprise Mg and the powder compact has a room temperature compressive strength of at least about 37 ksi.

16. A telescopic member as claimed in claim 15, wherein the dispersed particles comprise Mg and the powder compact has an actual density of about 1.738 g/cm$^3$ to about 2.50 g/cm$^3$.

17. A telescopic member as claimed in claim 1, wherein the dispersed particles comprise Mg and the powder compact has a room temperature shear strength of at least about 20 ksi.

18. A telescopic member as claimed in claim 1, wherein the powder compact has a predetermined theoretical density and an actual density that is substantially equal to the predetermined theoretical density.

19. A telescopic member as claimed in claim 1, wherein the particle core comprises Mg and the powder compact is selectably dissolvable at a rate of about 0 to about 7000 mg/cm$^2$/hr.

20. A telescopic member comprising:

at least a central component; and a barrier disposed within the central component, the barrier having a selectively tailorable material yield strength, wherein the barrier is constructed of a powder compact that comprises:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid state bond layer extending throughout the cellular nanomatrix between the dispersed particles.

* * * * *